United States Patent [19]

Fougere et al.

[11] 3,952,851

[45] Apr. 27, 1976

[54] COIN SELECTION METHOD AND APPARATUS

[75] Inventors: Guy L. Fougere, Arlington; Dennis C. Jeffreys, Bedford, both of Mass.

[73] Assignee: Mars, Inc., McLean, Va.

[22] Filed: May 8, 1974

[21] Appl. No.: 468,204

[30] Foreign Application Priority Data

May 18, 1973 United Kingdom ..... 23884/73

[52] U.S. Cl. ..... 194/100 A

[51] Int. Cl.[2] ..... G07F 3/02

[58] Field of Search ..... 194/100 R, 100 A; 73/163; 209/81, 81 A; 324/41, 3; 331/175, 183

[56] References Cited

UNITED STATES PATENTS

| | | | |
|---|---|---|---|
| 2,985,844 | 5/1961 | Wesch | 331/175 X |
| 3,317,016 | 5/1967 | Turillon | 194/100 R |
| 3,453,532 | 7/1969 | Gardiner | 324/41 X |
| 3,467,855 | 9/1969 | Rance | 324/3 |
| 3,576,244 | 4/1971 | Ptacek et al. | 194/100 R |
| 3,587,809 | 6/1971 | Meloni | 194/100 A |
| 3,653,481 | 4/1972 | Boxall et al. | 194/100 A |
| 3,739,895 | 6/1973 | Fougere et al. | 194/100 A |

*Primary Examiner*—Robert B. Reeves
*Assistant Examiner*—Joseph J. Rolla
*Attorney, Agent, or Firm*—Davis, Hoxie, Faithfull & Hapgood

[57] ABSTRACT

A method and apparatus for use in identification of coins is disclosed in which a coin is passed through the electromagnetic field of an inductor in an oscillator circuit and the changes in both the frequency and amplitude of oscillation of said oscillator circuit are separately detected.

6 Claims, 4 Drawing Figures

COIN SELECTION METHOD AND APPARATUS

This invention relates to coin selection and, more particularly, to methods and apparatus for identifying and authenticating coins by inductively testing their properties.

In accordance with the principles of the present invention, a coin is tested by detecting the effect of the interaction of a coin with an electromagnetic field produced by an inductor in an oscillator circuit upon both the real and imaginary components of impedance. This can be accomplished by monitoring the effect of the interaction of the coin with the field upon both the frequency and amplitude of oscillation of an oscillator in a coin selector apparatus. If desired, this test can be performed so that coin size is not a factor and coin material primarily is identified. If necessary for a particular set of coin denominations, the size or bulk of the coin can then be determined by other means, for example, by inductively testing the coin in a frequency range other than that employed in the frequency and amplitude test of the present invention. Such techniques are disclosed in the U.K. complete specification No. 1,397,083, which is assigned to the assignee of the present application. Since the effect of a given type of material at the surface of the coin on both the frequency and amplitude of an oscillator operated in accordance with the present invention is highly unique, coin selector apparatus constructed in accordance with the principles of this invention is particularly difficult to deceive with coins or slugs of other materials.

Further features of the invention, its nature, and various advantages will be more apparent upon consideration of the attached drawing and the following detailed description of the invention.

Figure 1:
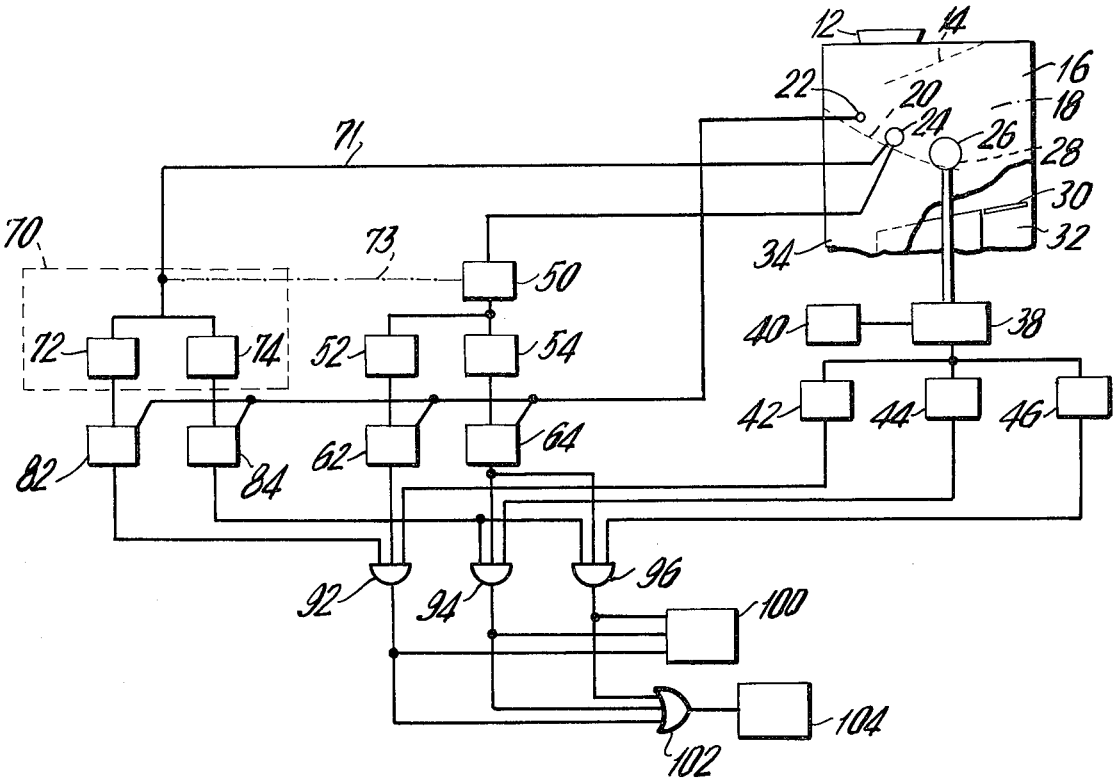
FIG. 1 is a schematic block diagram of a coin selector constructed in accordance with the principles of this invention.

Although coin selector apparatus constructed in accordance with the principles of this invention may be designed to identify and accept any number of coins from the coin sets of many countries, the invention will be adequately illustrated by explanation of its application to identifying the U.S. 5-, 10-, and 25-cent coins. Throughout this specification the term "coin" is intended to mean genuine coins, tokens, counterfeit coins, slugs, washers, and any other item which may be used by persons in an attempt to use coin-operated devices.

The mechanical portion of the coin selector of this invention may be similar to the mechanical portion of the coin selector shown, for example, in FIG. 12 of the U.K. complete specification mentioned above. Accordingly, in the mechanical portion of the coin selector shown in the FIG. 1 of the present application, a coin enters the apparatus through coin entry 12. The coin drops onto coin track 14 between sidewalls 16 and 18 and rolls down the coin track on its edge under the influence of gravity. Sidewalls 16 and 18 are parallel plates spaced apart by at least slightly more than the thickness of the thickest coin to be processed by the apparatus. In addition, sidewalls 16 and 18 may be tilted from the vertical so that a face of a coin rolling down coin track 14 (and later coin track 20) bears on front sidewall 16.

At the end of coin track 14, the coin drops onto coin track 20 (also between sidewalls 16 and 18) and continues to roll on its edge downward past inductor 24. An arrival sensor 22 (e.g., a photo-electric device) may be employed to detect the presence of the coin and produce an output signal pulse which is used to reset the coin recognition apparatus (in particular, flip-flops 62, 64, 82, and 84) discussed in detail below. Alternatively, the resetting may be initiated by the initial change of the output of inductor 24 when a coin enters its field.

Figure 2:
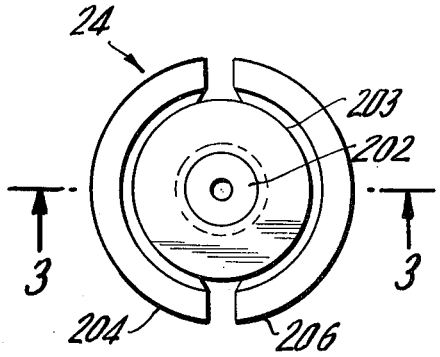
FIG. 2 is an elevational view of an inductor for use in the apparatus of FIG. 1.
Figure 3:
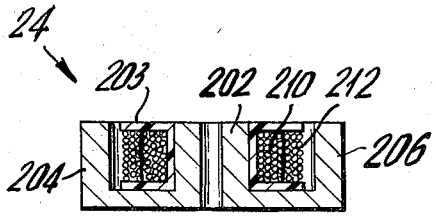
FIG. 3 is a sectional view of the inductor of FIG. 2 taken along the line 3—3.

As shown in FIGS. 2 and 3, inductor 24 is a circular pot core inductor including pole pieces 202, 204, and 206 and further including a bobbin 208 around central pole piece 202 on which primary and secondary coils 210 and 212 are concentrically wound. Inductor 24 may be similar to the inductor shown in FIGS. 5 and 6 of the above-mentioned specification to which secondary coil 212 has been added. Inductor 24 is mounted on the outside of sidewall 16 with the open faces of pole pieces 202, 204, and 206 (the pole faces visible in FIG. 2) toward the coin passageway between the sidewalls.

The primary coil of inductor 24 is included in an oscillator circuit, the remainder of which is represented in the block diagram of FIG. 1 by block 50. Primary coil 210 therefore carries an alternating current signal having frequency determined at least in part by the inductance of inductor 24. As a result of this alternating current signal carried by primary coil 210, an alternating electromagnetic field of the same frequency is set up between pole pieces 202, 204, and 206. At least part of the electomagnetic field penetrates into the coin passageway opposite inductor 24. As a coin rolls past inductor 24 on coin track 20, it interacts with this alternating electromagnetic field. This interaction decreases the effective inductance of inductor 24, which in turn causes the frequency of the oscillator circuit including inductor 24 (hereinafter referred to simply as oscillator 50) to increase. In particular, as a coin approaches inductor 24, the frequency of oscillator 50 increases from an idling frequency, reaches a peak when the coin is directly opposite inductor 24, and then returns to idling frequency as the coin rolls away from the inductor.

In general, the peak or maximum frequency reached by oscillator 50 will depend on a number of factors including coin size, material surface embossing, and physical separation. In the embodiment shown in FIG. 1, however, the electromagnetic field set up in the coin passageway by inductor 24 is sufficiently localized that coin size is not a factor which influences the interaction of this field with genuine coins of acceptable denominations. (If the inductor 24 were larger in diameter, coin diameter would also be a factor.) In addition, oscillator 50 operates at relatively high frequencies (e.g., at an idling frequency of approximately 420 kHz) so that the electromagnetic field set up by inductor 24 interacts primarily with the material of the coin closest to the inductor. In this way the apparatus principally examines the surface layer of laminated coins such as the United States 10- and 25-cent coins. The frequency is low enough, however, that the presence of the underlying copper can be detected and thereby the system can distinguish between laminated cupronickel and solid cupronickel. Since coin size is not a factor and since both of these coins have surface layers of the same material (i.e., 75/25 cupronickel) both of these coins have a similar effect on oscillator 50. The United States 5-cent coin, being of solid 75/25 cupronickel, has a different effect on oscillator 50. The peak or maximum frequency of oscillator 50 can therefore be used to indicate the surface conductivity and extent of surface embossing of a coin, and thus provides at least a partial indication of its denomination.

The signal produced by oscillator 50 is applied to frequency detectors 52 and 54, which may each be a narrow-band, band-pass filter of the type used for detectors 1154 through 1156 in the apparatus shown in FIG. 12 of the above-mentioned specification. Frequency detector 52 produces an output signal pulse while the output signal of oscillator 50 is at or near the peak frequency anticipated for a genuine 5-cent coin. Frequency detector 54 produces an output signal pulse while the output signal of oscillator 50 is similarly at or near the peak frequency anticipated for genuine 10- or 25-cent coins.

The output signals of frequency detectors 52 and 54 are applied to the input terminals of bistable or flip-flop devices 62 and 64, respectively. The output signal of flip-flop 62 is applied to one input terminal of logical AND gate 92 and the output signal of flip-flop 64 is applied to one input terminal of each of logical AND gates 94 and 96. Flip-flops 62 and 64 are initially in a logical reset condition as a result of the output signal pulse produced by arrival sensor 22. In the reset condition, flip-flops 62 and 64 produce output signals which inhibit AND gates 92, 94, and 96. When the output signal of oscillator 50 reaches the peak frequency associated with a genuine 5-cent coin, frequency detector 52 produces an output signal pulse which causes flip-flop 62 to change to the logical set state. Similarly, when the output signal of oscillator 50 reaches the peak frequency associated with genuine 10- or 25-cent coins, frequency detector 54 produces an output pulse which causes flip-flop 64 to change to the logical set state. In the set state, flip-flops 62 and 64 produce output signals which enable the associated AND gate or gates. If the maximum frequency of oscillator 50 substantially exceeds the peak frequency for any acceptable coin or coins, the frequency detector for that peak frequency produces two successive output pulses: one pulse as the frequency of oscillator 50 passes through the pass-band of the detector before reaching the maximum frequency, and a second pulse as the frequency returns from maximum to idling frequency through the pass-band of the detector. The first of these pulses triggers the associated flip-flop to the set state; the second pulse restores the flip-flop to the reset state. Accordingly, after a coin has passed inductor 24 flip-flop 62 will be set if and only if the maximum frequency reached by oscillator 50 was approximately the maximum frequency anticipated for a genuine 5-cent coin. Similarly, flip-flop 64 will be set if and only if the maximum frequency of oscillator 50 corresponds to the maximum frequency anticipated for genuine 10- or 25-cent coins.

When a metal object such as a coin passes inductor 24, not only does the frequency of oscillator 50 change, but the amplitude of that oscillation changes as well. It has been found that the effect of a given metal at a given spacing from inductor 24 provides for practical purposes a unique result in terms of the maximum effect on frequency and the maximum effect on amplitude. Thus it is practically impossible to stimulate the effect of one metal with another, or by a combination of conductive and non-conductive material.

In order to monitor both the frequency and amplitude of oscillator 50, inductor 24 includes secondary winding 212 which produces an output signal having an amplitude proportional to the amplitude of the primary winding signal. As is shown in FIG. 1, the secondary winding of inductor 24 is connected to amplitude detection circuit 70 which includes amplitude detectors 72 and 74. Amplitude detector 72 produces an output pulse applied to set initially reset flip-flop 82 when the amplitude of the secondary winding signal drops to approximately the level anticipated for a genuine 5-cent coin. Similarly, amplitude detector 74 produces an output pulse applied to set initially reset flip-flop 84 when the secondary winding signal drops to approximately the level anticipated for genuine 10- and 25-cent coins. Amplitude detectors 72 and 74 may each be a circuit which produces an output pulse either while the applied signal amplitude is within a predetermined amplitude range or while the applied signal amplitude is below a predetermined threshold level. In the former case, for example, amplitude detector 72 would produce one output pulse if the minimum secondary winding signal amplitude is within the predetermined range and two successive output pulses if the minimum secondary winding signal amplitude is below the predetermined range. One signal pulse would set normally reset flip-flop 82 to indicate the presence of a 5-cent coin; a second sucessive pulse (or no pulses at all) would leave flip-flop 82 in the reset condition indicating that the coin is not a genuine 5-cent coin. For most purposes, however, it has been been found that the added measure of protection afforded by this resetting type of amplitude detector is not needed and that a somewhat simpler single-threshold amplitude detector which produces an output pulse to set flip-flop 82 or 84, and thereby enable AND gate 92 or 94 and 96 respectively, is sufficient.

Figure 4:
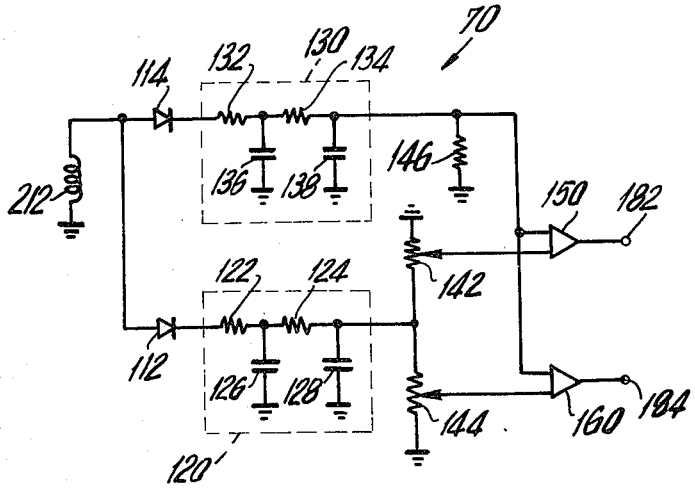
FIG. 4 is a schematic diagram of an embodiment of the amplitude detection portion of the apparatus of FIG. 1.

In the event that amplitude detectors 72 and 74 are of the single-threshold type, amplitude detection circuit 70 may be constructed as shown schematically in FIG. 4. In FIG. 4, coil 212 represents the secondary winding of inductor 24. The alternating current output signal of coil 212 is rectified by diodes 112 and 114. The rectified signal produced by diode 112 is smoothed by smoothing circuit 120, including resistors 122, 124 and capacitors 126, 128 connected as shown. The signal produced by diode 114 is smoothed by smoothing circuit 130, including resistors 132, 134 and capacitors 136, 138.

The time constant of smoothing circuit 120 is long as compared to machine cycle times, i.e., the time required for a coin to pass through the coin selector aparatus. Thus the level of the output signal of smoothing circuit 120 is proportional to the steady state amplitude of the output signal of oscillator 50. If the oscillator output signal amplitude should change for any reason such as a change of ambient temperature, change of voltage supply, aging of circuit components, or the like, there would be a corresponding change in the level of this direct current reference signal. The time constant of smoothing circuit 130 is much shorter, i.e., short as compared to the time required for a coin to pass inductor 24, but substantially longer than the period of oscillation of oscillator 50. In the absence of a coin, the output signal level of smoothing circuit 130 is nominally the same as the reference signal level produced by smoothing circuit 120. But as a coin approaches inductor 24, the level of the output signal of smoothing circuit 130 drops, reaches a minimum when the coin is directly opposite inductor 24, and then returns to the reference level after the coin has passed the inductor.

The output signal of smoothing circuit 120 is connected to ground by voltage dividing resistors 142 and 144. Voltage dividing resistor 142 is tapped at a potential just above the minimum potential reached by the output of the smoothing circuit 130 in the presence of a genuine 5-cent coin. This potential is connected to one input terminal of differential amplifier 150. The other input terminal of differential amplifier 150 is connected to the output of smoothing circuit 130. As long as the level of the output signal of smoothing circuit 130 is above the reference level established by voltage divider 142, differential amplifier 150 provides no output signal. When the level of the output signal of smoothing circuit 130 goes below that reference level differential amplifier 150 produces an output signal which is used to set flip-flop 82 in the apparatus of FIG. 1 by way of terminal 182. Accordingly, when the amplitude of oscillator 50 momentarily drops below the amplitude anticipated for genuine five-cent coins, differential amplifier 150 detects that condition and produces an output pulse which is used to set flip-flop 82.

Voltage dividing resistor 144 is tapped at the potential just above the minimum potential reached by the output of smoothing circuit 130 in the presence of a genuine 10- or 25-cent coin. This reference potential is connected to one input terminal of differential amplifier 160. The other input terminal of differential amplifier 160 is connected to the output of smoothing circuit 130. While the output signal level of smoothing circuit 130 is above the reference level established by voltage divider 144, differential amplifier 160 provides no output signal. When the output signal level of smoothing circuit 130 goes below that reference level, differential amplifier 160 produces an output signal applied to terminal 184 which is used to set flip-flop 84 in the apparatus of FIG. 1.

While the apparatus which has been described so far will distinguish between many varieties of coins, and may in itself be adequate for that purpose, it provides superior results in combination with means of examining other characteristics of coins, particularly means for examining bulk conductance characteristcs of coins. In the embodiment of FIG. 1, after passing inductor 24, the coin continues down coin track 20 toward inductors 26 and 28, which may be similar in structure and arrangement to inductors 1112 and 1113 in the apparatus shown in FIG. 12 of the above-mentioned specification. Inductors 26 and 28 are mounted opposite one another outside the coin passageway on sidewalls 16 and 18, respectively. Inductors 26 and 28 further test the properties of the coin, for example, by measuring the properties of the coin at a relatively low frequency (e.g., a frequency in the range from 5 to 7 kHz). In this arrangement, inductors 26 and 28 interact with the interior as well as exterior material of the coin, providing an indication of the bulk conductance of the coin. Inductors 26 and 28 are connected in series to bridge circuit 38 as described with respect to bridge circuit 1152 in the above-mentioned specification, which is driven by oscillator 40. Nulls in the output signal of bridge 38 corresponding to nulls produced by genuine 5-, 10-, and 25-cent coins are respectively detected by detectors 42, 44, and 46. Each of detectors 42, 44, and 46 applies a gate enabling signal to its respective AND gate 92, 94, or 96 when it detects such a null. If, as a coin passes between inductors 26 and 28, the signals applied to all the input terminals of any one of AND gates 92, 94, and 96 are gate enabling signals, that AND gate produces an output signal pulse indicating the presence of a 5-, 10-, or 25-cent coin, respectively. The output signals of AND gates 92, 94, and 96 are applied to coin accept gate actuator 104 by way of logical OR gate 102. A coin identifying output pulse produced by any of AND gates 92, 94 or 96 therefore causes actuator 104 to retract coin accept gate 30 as is required to accept the coin as it drops from the end of coin track 20. The output signals of AND gates 92, 94, and 96 are also applied to accumulator 100 which registers the value of the accepted coin and produces a "vend" signal when the value of the coins received equals or exceeds the value of the goods or services dispensed by the coin-operated machine.

With this apparatus, a coin would be accepted on the basis of concurrent indications of acceptability from flip-flops 62 and 64 and detectors 42, 44, and 46. Thus if both flip-flop 62 and detector 42 indicated the presence of a 5-cent coin, accumulator 100 could be incremented by 5 cents and coin accept gate 30 actuated by actuator 104 to accept the coin. Similarly, if both flip-flop 64 and detector 44 or flip-flop 64 and detector 46 indicated the presence of a 10-or 25-cent coin, respectively, accumulator 100 could be incremented by the appropriate amount and the coin accepted. The coin is then actually accepted by retracting accept gate 30 into sidewall 18, thereby allowing a coin leaving the end of coin track 20 to fall into chute 32 leading to a coin box (not shown). If the coin is not to be accepted, accept gate 30 is not retracted as described above and therefore diverts the coin falling from the end of coin track 20 into chute 34 leading to coin return window (also not shown).

While the foregoing description has been in terms of the use of a particular freqency, frequencies in other ranges may be used in accordance with the method and apparatus of the present invention. For example, it may be desirable to employ a frequency of approximately 2 MHz or even as high as 10 or 11 MHz when the present invention is employed with a coin set such as the West German 5, 10 and 25 pfennig coins which have a thin outer cladding of tombac over a steel core. The circuitry to accomplish the purposes of the present invention should also not be limited to that described above. For example, the same beneficial results can be obtained if, instead of directly monitoring change in the amplitude of the oscillator 50 with amplitude detectors 72 and 74 comprising the amplitude detection circuit 70, oscillator 50 may be an amplitude stabilized oscillator and the amplitude detectors 72 and 74 would then be connected to monitor the control signal amplitude of the amplitude stabilized oscillator, by a direct connection to the oscillator 50 via lead 73 in lieu of the use of lead 71 or transmission of the oscillator amplitude itself over lead 73.

We claim:

1. Apparatus for examining conductive coins with respect to authenticity and denomination comprising an oscillator circuit including an inductor arranged to subject a face of a coin to an electromagnetic field, wherein the presence of the coin or other conductive object within the field affects the frequency of the oscillator, first means for producing a first alternating current signal representative of the output of the oscillator with respect to the effect of the presence of a coin within the field upon the amplitude of oscillations of the oscillator, said first means comprising a first detecting circuit having a time constant greater than one machine cycle to produce a reference signal, a second detecting circuit having a time constant greater than one period of oscillation of the lowest oscillator frequency and substantially less than 20 milliseconds, and a comparator to compare the output of the first detecting circuit with the output of the second detecting circuit, second means for producing a second signal representative of the output of the oscillator with respect to the effect of the presence of a coin within the field upon the oscillator frequency, means for comparing a value of each of the first and second signals respectively to correspondng values representative of an acceptable coin and indicating the presence of an acceptable coin, and combinatorial means to produce a third signal when the comparing means indicate the presence in the field of an acceptable coin of the same denomination as indicated by the first and second signals.

2. The apparatus of claim 1 further comprising means for causing relative motion of the coin through the field along a predetermined path wherein the examination of the coin is conducted while it is moving.

3. The apparatus of claim 1 wherein the inductor comprises a first winding connected to the oscillator and a second winding which produces the first signal.

4. The apparatus of claim 1 wherein the first detecting circuit further comprises a divider which is preset to provide the reference signal at an amplitude corresponding to the peak amplitude of the output of the second detecting circuit when an acceptable coin is in the presence of the field.

5. The apparatus of claim 1 wherein the oscillator is connected with the inductor so that the presence of conductive material in the field produced by the inductor causes the frequency of oscillation to shift from its idle frequency.

6. The apparatus of claim 5 wherein the second means for producing a second signal comprises a narrow band detector circuit responsive to the output of the oscillator for detecting a predetermined frequency shifted from the oscillator's idle frequency and producing a signal indicative of the occurrence of the shifted frequency, wherein the detector circuit produces an output pulse for each transition of the frequency of the oscillator into the bandpass of the detector.

* * * * *